United States Patent [19]

Sawanishi et al.

[11] Patent Number: 4,510,111

[45] Date of Patent: Apr. 9, 1985

[54] PROCESS FOR PRODUCING ACRYLIC FIBERS HAVING NON-CIRCULAR CROSS-SECTIONS

[75] Inventors: Shigeru Sawanishi; Yozo Shiomi; Akira Yamane, all of Okayama, Japan

[73] Assignee: Japan Exlan Company Limited, Osaka, Japan

[21] Appl. No.: 526,881

[22] Filed: Aug. 26, 1983

[30] Foreign Application Priority Data

Sep. 6, 1982 [JP] Japan ..... 57-155562

[51] Int. Cl.[3] ..... D01D 5/06; D01F 6/18; D01F 11/04

[52] U.S. Cl. ..... 264/177 F; 264/182; 264/210.8; 264/211; 264/289.3

[58] Field of Search ..... 264/182, 177 F, 210.3, 264/210.8, 211, 289.3

[56] References Cited

FOREIGN PATENT DOCUMENTS 38-9314 6/1963 Japan ..... 264/182
47-5448 2/1972 Japan ..... 264/182

*Primary Examiner*—Donald Czaja
*Assistant Examiner*—Hubert C. Lorin
*Attorney, Agent, or Firm*—Wenderoth, Lind & Ponack

[57] ABSTRACT

The present invention provides an industrial process for producing acrylic fibers having non-circular cross-sections which are excellent in gloss, softness, etc. In this process, which is a wet-spinning method using an inorganic solvent, a particular acrylonitrile polymer solution is spun through a spinnerette having circular spinning orifices. The steps of spinning, coagulation, water-washing and wet-heat stretching are carried out in integral combination and under specific conditions.

7 Claims, No Drawings

PROCESS FOR PRODUCING ACRYLIC FIBERS HAVING NON-CIRCULAR CROSS-SECTIONS

BACKGROUND OF THE INVENTION

1. Field of the Invention

This invention relates to a process for producing acrylic fibers having non-circular cross-sections by wet-spinning an inorganic solvent solution of an acrylonitrile polymer through a spinnerette having circular spinning orifices. More particularly, the invention relates to a process for producing acrylic fibers having non-circular cross-sections which are excellent in gloss, softness, etc., in which process a particular acrylonitrile polymer solution is spun and coagulated, and the resulting filaments are washed with water and stretched in wet heat, these process steps being carried out in integral combination and under specific conditions.

2. Description of the Prior Art

The processes for producing acrylic fibers are classified broadly into wet-spinning methods and dry-spinning methods, and in each of these methods, fibers of characteristic features are produced. In respect of touch feel such as softness, slipperiness, etc., the fibers produced by the latter method are better by the reason of their fiber cross-sectional shape such as cocoon shape or heart shape, and the smoothness of the fiber surface. In wet-spinning method, especially that using an inorganic solvent, the speed of solvent removal at the time of coagulation is slow and the coagulation occurs uniformly throughout the outer and inner layers of the fiber, so that fibers with circular cross-sections are liable to be formed, and in addition, because of numerous wrinkles formed on the fiber surface, the fibers do not necessarily have the so-called animal hair-like touch and are not satisfactory in gloss, softness, slipperiness, etc.

Heretofore, much effort has been directed to the attainment of processes of providing fibers having non-circular cross-sections by wet-spinning method using an inorganic solvent. All of these processes have not been satisfactory from an industrial viewpoint. For example, as described in Japanese Patent Publication No. 2328/1970, satisfactory fibers having non-circular cross-sections can be obtained by using a plastic-made spinnerette having non-circular orifices, but this process involves an industrial problem in that the productivity is low because the spinnerette has a low pressure resistance. Also, a method was proposed wherein fibers extruded through a metallic spinnerette having circular orifices located near to each other, are agglutinated and united to form fibers with non-circular cross-sections. In this method, however, there is an unevenness in agglutination between the peripheral and central parts of the spinnerette, so that there are different cross-sectional shapes and also fibers of non-united, circular cross-sections are present in mixture.

SUMMARY OF THE INVENTION

In the light of such a situation, we conducted research to provide a process for producing acrylic fibers having non-circular cross-sections, which are free from the above-mentioned defect, by a wet-spinning method using an inorganic solvent. As a result, it has been found that, when spinning and coagulation of a particular acrylonitrile polymer spinning solution and water-washing and wet-heat stretching of the resulting filaments are carried out in integral combination and under specific conditions, acrylic fibers having non-circular cross-sections which are excellent in gloss, softness and slipperiness can be produced, in spite of using a spinnerette having circular spinning orifices. The present invention has been accomplished on the basis of this discovery.

Therefore, an object of the present invention is to provide an industrially advantageous process for producing acrylic fibers having non-circular cross-sections which have an excellent animal hair-like touch, by a wet-spinning method using a spinnerette with circular spinning orifices and using an inorganic solvent.

Another object of the present invention is to provide a process for producing acrylic fibers having non-circular cross-sections which will be greatly improved in slipperiness when treated with a softening agent, and are excellent in gloss, transparency, softness, bulkiness, etc. Other objects of the present invention will become apparent from the following detailed explanation of the invention.

The above-mentioned objects of the invention are attained by integrally combining the following process steps:

(1) preparing an acrylonitrile polymer spinning solution of 40°–70° C. by dissolving an acrylonitrile polymer in an inorganic solvent, which spinning solution has a viscosity of 40–200, poises at 30° C., (2) wet-spinning the spinning solution through a spinnerette with circular spinning orifices and holding it in a first coagulating bath having a solvent concentration of from 5 to 35 weight % and having a temperature of from −5° to 5° C. for a duration of time from $d \times \frac{1}{4}$ to d seconds (wherein d is the single-filament denier number of the fibers to be finally obtained), (3) holding the resulting coagulated gel filaments in a second coagulating bath having a solvent concentration of from 5 to 35 weight % and having a temperature of from 6° to 40° C. for a duration more than d seconds, (4) water-washing the coagulated gel filaments and wet-heat stretching the filaments more than 4 times in length at a temperature higher than 80° C. thereby to produce fibers having a degree of flatness more than 1.5. Only by employing this process, can there be obtained acrylic fibers with non-circular cross-sections which are excellent in gloss, softness, etc. while using a spinnerette with circular spinning orifices.

DETAILED DESCRIPTION OF PREFERRED EMBODIMENT

In the following, the present invention will be explained in detail:

Firstly, the acrylonitrile polymers to be used in the present invention are polymers containing combined therein more than 50 weight %, preferably more than 80 weight %, of acrylonitrile. As examples of the monomers copolymerizable with acrylonitrile, there can be cited vinyl acetate, acrylamide, acrylic acid and its esters, methacrylic acid and its esters, halogen-containing monomers such as vinyl chloride, vinylidene chloride, vinyl bromide, etc., sulfonic acid group-containing monomers such as sodium methallyl sulfonate, sodium styrene sulfonate, etc. However, as far as the monomers are copolymerizable with acrylonitrile, they are not limited to the above-mentioned monomers.

As the inorganic solvents to be used for producing a spinning solution by dissolving such acrylonitrile polymers, there can be cited aqueous solutions of nitric acid, thiocyanates, zinc chloride, etc.

For such a spinning solution produced by dissolving an acrylonitrile polymer in an inorganic solvent, it is necessary to have a viscosity of 40 to 200 poises at 30° C. By employing a spinning solution having a viscosity within such a range, it is possible to produce fibers having excellent transparency and color development, without problems such as the pressure resistance of the spinnerette, and in addition, cojointly with the other constitutive requirements of the present invention, it is possible to produce acrylic fibers with non-circular cross-sections which have the excellent touch sought by the present invention. Also, as for the temperature of the spinning solution, it is necessary to employ a temperature within the range of from 40° to 70° C. When the temperature is outside the lower limit of the range, there will be a difficulty in spinnability upon high-speed spinning. Also, when the temperature exceeds the upper limit of the range, voids will be formed in the fibers at the time of coagulation, making it impossible to form fibers of good transparency and good color development.

There is no limitation on the spinnerette through which the spinning solution is extruded, and it is possible to use any spinnerette having circular orifices generally used in the wet-spinning method.

Next, an explanation will be given on the coagulation process of the spinning solution after the extrusion through the spinnerette orifices having a circular cross-section. This process is particularly important for the attainment of the objects of the present invention. It is necessary to carry out this coagulation process in two steps as follows:

The first step is to hold the extruded spinning solution in the first coagulating bath having a solvent concentration of 5–35 weight % and maintained at a temperature between −5° C. and 5° C., for a duration of from $d \times \frac{1}{4}$ to d seconds (wherein d is the single-filament denier number of the fibers to be finally obtained). The second step is to hold in the second coagulating bath having a solvent concentration of 5–35 weight % and maintained at a temperature between 6° C. and 40° C., for a duration more than d seconds.

By the two-step coagulation under the conditions recommended in the present invention, it is possible to form in the fiber structure a dense skin layer having a suitable anti-shrinking force and a core layer of gel structure which can exhibit a shrinking force larger than the anti-shrinking force of the skin layer. By virtue of harmony between the antishrinking force of the skin layer and the shrinking force of the core layer, which resulted from the fiber cross-sectional structure formed in this coagulation process, it is possible to develop the non-circular cross-sectional shape in the subsequent wet-heat stretching step. When the coagulation duration in the first bath is less than $d \times \frac{1}{4}$, the formation of the skin layer will be insufficient, and the skin layer will be deformed freely in accordance with the shrinkage of the core layer, so that fibers with non-circular cross-sections having protrusions will be formed. Also, when the coagulation duration of the first bath exceeds d seconds, the anti-shrinking force of the skin layer will become too large and it will be impossible to form fibers of non-circular cross-sections by the shrinking force of the core layer. Furthermore, in the second bath, the coagulation temperature is especially important. When this temperature is lower than the lower limit, it will be impossible for the core to have a suitable shrinking force. On the contrary, when this temperature exceeds the upper limit, the transparency of the fibers will be lowered, and only fibers of low color development will be obtained. To bring the shrinking force of the skin layer and that of the core layer into harmony, it is desirable to rapidly elevate the temperature of the coagulated gel fibers at the time of the second coagulation. There is no particular limitation on such means. However, a suggested method is to treat the coagulated gel fibers with a shower of the second coagulating bath solution, which is 10 to 100 times in quantity relative to the quantity of the extruded polymer.

The coagulated gel fibers thus obtained are cold-stretched 1.01 to 3 times if desired, and then washed with water. Thereafter, it is necessary to wet-heat stretch the fibers more than 4 times, preferably more than 5 times at a temperature higher than 80° C.

The atmospheres in which the wet-heat stretching is carried out are not particularly limited so far as they satisfy a temperature above 80° C., and as such atmospheres there can be mentioned hot water, saturated steam, superheated steam, and a mixture of steam and air. However, from the viewpoint of industrial convenience, it is preferable to use hot water. When this temperature is lower than 80° C., the stretchability of the fibers will be poor, and in addition, it will be impossible to develop sufficient non-circular cross-sectional shapes.

It is desirable that the stretching time of the wet-heat stretching plus cold stretching should be 6–18 times in total, and more desirably 8–16 times. When the stretching times is less than the lower limit of the range recommended in the present invention, it will be impossible to provide fibers having physical properties satisfactory in practical use, and also it will be impossible to develop satisfactory non-circular cross-sectional shapes at which the present invention aims.

The fibers thus produced may be further suitably subjected in the usual way to wet-heat relaxing treatment, re-stretching treatment in a wet-heat or dry-heat atmosphere, crimping treatment, oiling treatment, drying treatment, etc.

When the process requirements as mentioned above recommended in the present invention are employed in integral combination, it is possible to produce acrylic fibers of cocoon or almond cross-sectional shape having a degree of flatness of more than 1.5, preferably more than 2.0 by wet-spinning method using a spinnerette having circular spinning orifices and an inorganic solvent. This is an effect of the present invention worthy of special mention.

It is also a characteristic effect of the present invention that acrylic fibers having an animal hair-like touch which are satisfactory in gloss, softness, transparency and color development, can be produced industrially advantageously, without requiring any special installations.

Such fibers with the animal hair-like touch, singly or as a material for mixing with animal hair, can be made into products having a very high commodity value.

In the following, the present invention will be explained in further detail by way of Example but it is to be understood that the invention is not limited by the Example, wherein all percentages are by weight.

The transparency, 60° mirror surface gloss and flatness of fiber, described in the following Examples are values measured or calculated as follows:

(1) Transparency (%)

In 17.0 g of tricresyl phosphate, of which the refractive index at 30° C. has been adjusted to 1.5004 with ethyl alcohol, 0.105 g of test fibers cut in 2 mm lengths are dispersed. Using a 5 cm cell, the percent light transmission of the dispersion at the wave length of 420 mμ is measured. This value is indicated as the transparency.

(2) 60° mirror surface gloss ($G_s^{60}$)

The fiber bundle to be tested is straightened under heat and tension to remove crimps if any, and the fibers are arranged parallel in order. Both ends of the parallel fibers are fixed to a board to prepare a rectangular test piece (6 cm×4.5 cm).

Using a GM-5 type glossmeter (produced by Murakami Color Technical Research Laboratory) and in accordance with the method of JIS Z-8741, a ray of light is irradiated on the surface of this test piece so that the plane including the ray of incidence and the ray of reflection will be in coincidence with the axial line of the test fibers and so that the angle of incidence of the irradiated ray will form an angle of 60° with the direction of the arrangement of the fibers. In this way the 60° mirror surface gloss is measured.

(3) Degree of flatness

This is a mean value of the ratio of the longer diameter of the smallest circumcircle to the longer diameter of the largest inscribed circle of each of the cross-sections of 100 test fibers.

EXAMPLE

An acrylonitrile polymer (limiting viscosity number in dimethylformamide at 30° C.: 1.10) consisting of 90% acrylonitrile, 9.8% methyl acrylate and 0.2% sodium methally sulfonate) was dissolved in an aqueous solution of sodium thiocyanate, 50% in concentration, to prepare a spinning solution having a viscosity of 60 poises at 30° C. This spinning solution maintained at 65° C. was extruded through a metallic spinnerette having 50 circular orifices, each 0.07 mm in diameter, into an aqueous 10% sodium thiocyanate solution maintained at 0° C. (1st coagulating bath) and was held in the bath for 1.5 seconds. The coagulated spinning solution was further held in an aqueous 10% sodium thiocyanate solution (2nd coagulating bath) maintained at 30° C. for 3.5 seconds.

The resulting coagulated filaments were cold-stretched 2.0 times in length, washed with water to remove the solvent, stretched in boiling water, dried in an atmosphere having a dry bulb temperature of 120° C. and a wet bulb temperature of 60° C., and subjected to relaxing heat treatment in saturated steam at 130° C. thus to produce Fiber A of 3 deniers.

Fiber B was produced in the same way as above except that in place of immersion in the second coagulating bath solution, the coagulated gel filaments were treated with a shower of an aqueous 10% sodium thiocyanate solution of 10° C. which was 30 times in quantity relative to the quantity to the extruded polymer.

Six kinds of Fibers C-H were produced in the same way as Fiber B except that the temperature of the spinning solution, the temperatures and concentrations of the coagulating baths, and the holding time in the coagulating baths were varied as described in Table 1.

Fiber I was produced following the above procedure except that the holding time in the first bath was 6 seconds and the second bath was omitted. Fiber J was produced following the above procedure except that the wet-heat stretching ratio was 3.0 times.

The results of measurement of various characteristics of the ten kinds of test fibers thus obtained are shown in Table 1.

TABLE 1

| | | No. | | | | | | | | | |
|---|---|---|---|---|---|---|---|---|---|---|---|
| | | Fiber of the invention | | | | Fiber for comparison | | | | | |
| Test Fiber | | A | B | C | D | E | F | G | H | I | J |
| Conditions of spinning | | | | | | | | | | | |
| Spinning solution | temperature (°C.) | 65 | → | 55 | → | → | → | → | → | 65 | → |
| 1st coag. bath | solvent conc. (%) | 10 | → | 18 | 15 | → | → | → | → | 10 | → |
| | temperature (°C.) | 0 | → | → | 3 | 6 | 0 | → | → | → | → |
| | holding time (sec.)* | 1.5 | → | 0.8 | 2.8 | 1.5 | 4 | 1.5 | → | 6.0 | 1.5 |
| 2nd coag. bath | solvent conc. (%) | 10 | → | 18 | 10 | 10 | → | → | → | | 10 |
| | temperature (°C.) | 30 | 10 | 20 | → | 10 | → | 5 | 20 | | 30 |
| | holding time (sec.) | 3.5 | → | → | → | → | → | → | 2.0 | | 3.5 |
| | immersion or shower | immersion | shower | → | → | → | → | → | → | | shower |
| Wet-heat stretching | temperature (°C.) | 100 | → | → | → | → | → | → | → | → | → |
| | stretching ratio (times) | 5.0 | → | → | → | → | → | → | → | → | 3.0 |
| Characteristics of the fiber | | | | | | | | | | | |
| Dry strength (g/d) | | 2.8 | 3.0 | 3.0 | 2.9 | 2.6 | 3.2 | 3.4 | 3.1 | 3.4 | 2.2 |
| Dry elongation (%) | | 44 | 46 | 44 | 46 | 45 | 47 | 46 | 44 | 45 | 61 |
| Transparency (%) | | 73 | 81 | 79 | 75 | 60 | 75 | 76 | 72 | 77 | 69 |
| 60° mirror surface gloss ($G_s^{60}$) | | 35 | 37 | 36 | 34 | 27 | 28 | 29 | 28 | 27 | 29 |
| Shape of fiber cross-section | | cocoon | → | → | → | almond | circular | non-circ. | almond | circ. | non-circ. |
| Degree of flatness of fiber cross-section | | 2.2 | 2.7 | 2.6 | 2.0 | 1.2 | 1.0 | 1.2 | 1.4 | 1.0 | 1.3 |

*Time spent from the surface of the spinnarette until contact with the second bath.

As apparent from the results in Table 1, it is understood that the Fibers A-D of the present invention have excellent degree of flatness and gloss, and in addition their strength, elongation and transparency are on a level satisfactory for practical use, that is to say, they have characteristics that can heighten their commodity value remarkably.

What is claimed is:

1. A process for producing acrylic fibers having non-circular cross-sections, of which the degree of flatness is more than 1.5, characterized by integrally combining the following process requirements:

(1) preparing an acrylonitrile polymer spinning solution of 40°–70° C. by dissolving an acrylonitrile polymer in an inorganic solvent, which spinning solution has a viscosity of 40–200 poises at 30° C., (2) wet-spinning the spinning solution through a spinnerette having circular spinning orifices, and holding it in a first coagulating bath, 5–35 weight % in solvent concentration and having a temperature of −5° C. to 5° C., for a duration of time of $d \times \frac{1}{4}$ to d seconds, wherein d is the single-filament denier number of the fibers to be finally obtained, (3) holding the coagulated gel filaments in a second coagulating bath, 5–35 weight % in solvent concentration and having a temperature from 6° C. to 40° C., for a duration of time more than d seconds, (4) washing the coagulated gel filaments with water and wet-heat stretching the filaments 4 times in length at a temperature higher than 80° C.

2. The process as claimed in claim 1 wherein as the acrylonitrile polymer a polymer containing combined therein more than 50 weight % acrylonitrile is used.

3. The process as claimed in claim 1 wherein as the inorganic solvent, an aqueous solution of nitric acid, thiocyanates or zinc chloride is used.

4. The process as claimed in claim 1 wherein the temperature of the second coagulating bath is from 10° C. to 30° C.

5. The process as claimed in claim 1 wherein the coagulated gel filaments are cold-stretched 1.01–3 times and then washed with water.

6. The process as claimed in claim 1 wherein the coagulated gel filaments are wet-heat stretched in hot water.

7. The process as claimed in claim 1 wherein the total stretching ratio is 6–18 times.

* * * * *